US006850262B2

(12) United States Patent
Yoshida et al.

(10) Patent No.: US 6,850,262 B2
(45) Date of Patent: Feb. 1, 2005

(54) THERMAL ACTIVATION DEVICE FOR HEAT-SENSITIVE SELF-ADHESIVE SHEET AND A PRINTER ASSEMBLY EMPLOYING THE SAME

(75) Inventors: Shinichi Yoshida, Chiba (JP); Yoshinori Sato, Chiba (JP); Minoru Hoshino, Chiba (JP); Masanori Takahashi, Chiba (JP)

(73) Assignee: SII P & S Inc., Chiba (JP)

( * ) Notice: Subject to any disclaimer, the term of this patent is extended or adjusted under 35 U.S.C. 154(b) by 0 days.

(21) Appl. No.: 10/612,566

(22) Filed: Jul. 2, 2003

(65) Prior Publication Data

US 2004/0119809 A1 Jun. 24, 2004

(30) Foreign Application Priority Data

Aug. 27, 2002 (JP) ..... 2002-247380

(51) Int. Cl.[7] ..... B41J 2/325; B65C 9/24; B65C 9/25; B65C 11/02

(52) U.S. Cl. ..... 347/171; 156/320; 156/322; 156/384; 156/387

(58) Field of Search ..... 347/171, 220, 347/223; 156/320, 322, 384, 387, DIG. 21, DIG. 36; 400/701

(56) References Cited

U.S. PATENT DOCUMENTS

| | | | | | |
|---|---|---|---|---|---|
| 4,397,709 | A | * | 8/1983 | Schwenzer | 156/351 |
| 4,468,274 | A | * | 8/1984 | Adachi | 156/320 |
| 4,707,211 | A | * | 11/1987 | Shibata | 156/354 |
| 4,784,714 | A | * | 11/1988 | Shibata | 156/354 |
| 5,846,358 | A | * | 12/1998 | Nagamoto et al. | 156/64 |
| 6,031,553 | A | | 2/2000 | Nagamoto et al. | 347/171 |
| 6,172,698 | B1 | | 1/2001 | Iwata et al. | 347/171 |
| 6,501,495 | B1 | * | 12/2002 | Ichikawa et al. | 347/171 |
| 2004/0066448 | A1 | * | 4/2004 | Hoshino et al. | 347/220 |

FOREIGN PATENT DOCUMENTS

| | | | | |
|---|---|---|---|---|
| EP | 0788972 | | 8/1997 | |
| JP | 02-117846 | * | 5/1990 | 347/171 |
| JP | 03-010875 | * | 1/1991 | 400/701 |

OTHER PUBLICATIONS

Patent Abstracts of Japan vol. 2000, no. 02, (Feb. 29, 2000) JP 11 327447 A (Ricoh Co. Ltd), (Nov. 26, 1999).

* cited by examiner

*Primary Examiner*—Huan Tran
(74) *Attorney, Agent, or Firm*—Adams & Wilks

(57) ABSTRACT

A thermal activation device (thermal activation unit A1) for heat-sensitive self-adhesive sheet at least includes: a thermally-activating thermal head for thermally activating a heat-sensitive adhesive layer of a heat-sensitive self-adhesive sheet including a sheet-like substrate formed with a printable surface on one side thereof and with the heat-sensitive adhesive layer on the other side thereof; and a platen roller (41) for conveying the heat-sensitive self-adhesive sheet in a predetermined direction, the device wherein the platen roller includes adhesive-mass removing means for removing an adhesive mass (G2) of the heat-sensitive adhesive adhered to a periphery of the platen roller, and wherein the adhesive-mass removing means includes: a transfer roller (42) slidably contacting the periphery of the platen roller as located near an exit of the heat-sensitive self-adhesive sheet, thereby allowing the adhesive mass adhered to the periphery of the platen roller to be transferred thereto; and a cleaning sheet (heat-sensitive self-adhesive sheet R) inserted through space between the transfer roller and the platen roller thereby removing the adhesive mass adhered to a periphery of the transfer roller by allowing the adhesive mass to be transferred thereto.

10 Claims, 7 Drawing Sheets

THERMAL ACTIVATION DEVICE FOR HEAT-SENSITIVE SELF-ADHESIVE SHEET AND A PRINTER ASSEMBLY EMPLOYING THE SAME

BACKGROUND OF THE INVENTION

1. Field of the Invention

The present invention relates to a thermal activation device for heat-sensitive self-adhesive sheet and a printer assembly employing the thermal activation device, the heat-sensitive self-adhesive sheet having a heat-sensitive adhesive layer which is formed on one side of a sheet-like substrate of the sheet and which is normally non-adhesive but develops adhesiveness when heated. Particularly, the invention relates to a technique for effectively removing heat-sensitive adhesive mass adhered to a platen roller.

2. Description of the Related Art

In recent years, a thermally active sheet (a print medium, such as a heat-sensitive self-adhesive sheet, which has a coat layer of a thermally active component formed on top surface thereof) has been known as a kind of sheet affixed to products. The thermally active sheets have found a wide range of applications such as POS sheets affixed to food products, affixing sheets used in physical distribution/delivery, sheets affixed to medical products, baggage tugs, indication sheets affixed to bottles or cans and the like.

The heat-sensitive self-adhesive sheet R includes a sheet-like sheet substrate (such as a base paper); a heat-sensitive adhesive layer formed on a back side of the substrate and being normally non-adhesive but developing adhesiveness when heated; and a printable surface formed on a front side of the substrate.

Specifically, as shown in FIG. 7, a thermal coat layer 501 as a heat-sensitive color developing layer defining a printable surface is formed on one side of a base paper 500 (front side as seen in FIG. 7) as the sheet substrate, and a colored print layer 502 printed with characters or a pattern, such as a price frame, unit and the like, is formed on the thermal coat layer. On the other side of the base paper (back side as seen in FIG. 7), a heat-sensitive adhesive layer K is formed by applying a heat-sensitive adhesive based on a thermoplastic resin, a solid plasticizer and the like.

The heat-sensitive adhesive includes a thermoplastic resin, a solid plasticizer and the like as the major components thereof, and has a nature that the heat-sensitive adhesive is non-adhesive at normal temperatures but is activated to develop the adhesiveness when heated by the thermal activation device. Normally, activation temperatures are in the range of 50 to 150° C., in which range the solid plasticizer in the heat-sensitive adhesive is molten to impart the adhesiveness to the thermoplastic resin. The molten solid plasticizer is gradually crystallized via a supercooled phase so that the adhesiveness is maintained for a given period of time. While the heat-sensitive adhesive exhibits the adhesiveness, the sheet is affixed to a support object such as a glass bottle or the like.

The heat-sensitive self-adhesive sheet R is subjected to a thermal printer assembly with a thermal head for printing a desired character(s) or image on the printable surface thereof and thereafter, subjected to the thermal activation device for activation of the heat-sensitive adhesive layer K thereof.

On the other hand, a printer assembly is now under development, which incorporates therein the thermal activation device for sequentially conducting thermal printing on the heat-sensitive self-adhesive sheet and activation of the heat-sensitive adhesive layer thereof.

Such a printer assembly has an arrangement as shown in FIG. 6, for example.

Referring to FIG. 6, a reference sign P1 represents a thermal printer unit, a sign C1 representing a cutter unit, a sign A2 representing a thermal activation unit, a sign R representing a heat-sensitive self-adhesive sheet wound into a roll.

The thermal printer unit P1 includes a printing thermal head 100, a platen roller 101 pressed against the printing thermal head 100, and an unillustrated drive system (including an electric motor, and gear array, for example) for rotating the platen roller 101.

As seen in FIG. 6, the platen roller 101 is rotated in a direction D1 (clockwise) thereby paying out the heat-sensitive self-adhesive sheet R, which, in turn, is subjected to thermal printing and then discharged in a direction D2 (rightward). The platen roller 101 further includes unillustrated pressure means (such as a helical spring or plate spring), a resilient force of which acts to bias the platen roller 101 surface against. the thermal head 100.

The printing thermal head 100 and platen roller 101 are operated based on a print signal from an unillustrated print control unit, thereby accomplishing desired printing on the thermal coat layer 501 of the heat-sensitive self-adhesive sheet R.

The cutter unit Cl serves to cut the heat-sensitive self-adhesive sheet R, thermally printed by the thermal printer unit P1, in a proper length. The cutter unit includes a movable blade 200 operated by a drive source (not shown) such as an electric motor, and a fixed blade 201. The movable blade 200 is operated at a predetermined timing under control of the unillustrated control unit.

The thermal activation unit A2 includes an insertion roller 300 and a discharge roller 301 rotated by, for example, an unillustrated drive source for inserting and discharging the cut heat-sensitive self-adhesive sheet R; a thermally-activating thermal head 400 interposed between the insertion roller 300 and the discharge roller 301; and a platen roller 401 pressed against the thermally-activating thermal head 400. The platen roller 401 includes an unillustrated drive system (an electric motor and gear array, for example), which rotates the platen roller 401 in a direction D4 (a counter-clockwise direction as seen in FIG. 6) so that the heat-sensitive self-adhesive sheet R is conveyed in a direction D6 (a rightward direction as seen in FIG. 6) by the insertion roller 300 and discharge roller 301 rotated in respective directions D3 and D5. On the other hand, the platen roller 401 includes unillustrated pressure means (such as a helical spring or plate spring), a resilient force of which acts to bias the platen roller 401 surface against the thermally-activating thermal head 400.

In FIG. 6, a reference sign S represents a discharge detection sensor for detecting the discharge of a heat-sensitive self-adhesive sheet R. The printing, conveyance and thermal activation of the subsequent heat-sensitive self-adhesive sheet R are performed in response to the discharge detection sensor S detecting the discharged heat-sensitive self-adhesive sheet R.

The thermally-activating thermal head 400 and the platen roller 401 are operated at a predetermined timing under control of the unillustrated control unit, while the heat-sensitive adhesive layer K of the heat-sensitive self-adhesive sheet R is activated by heat generated by energizing the thermally-activating thermal head 400, thereby developing an adhesive force.

After the adhesive force of the heat-sensitive self-adhesive sheet R is developed by the thermal activation unit A2 thus arranged, an indication label, price label or advertisement label may be affixed to glass bottles containing liquors or medical agents or to plastic containers. This negates the need for a separation sheet (liner) provided at the adhesive label sheet commonly used in the art, providing a merit of cost reduction. In addition, the invention provides further merits in terms of resource savings and environmental problems because the separation sheets producing wastes after use are not required.

However, the conventional thermal activation unit A2 for heat-sensitive self-adhesive sheet R encounters a problem that the heat-sensitive adhesive is adhered to conveyance means (particularly, the platen roller 401) for the heat-sensitive self-adhesive sheet R.

Specifically, when the heat-sensitive self-adhesive sheet R cut in a predetermined length by the cutter unit C2 is thermally activated at the heat-sensitive adhesive layer K thereof by means of a heat generating element H of the thermally-activating thermal head 400 and then released from the platen roller 401, a part of the heat-sensitive adhesive of the heat-sensitive adhesive layer K, softened (liquefied) by heating, is squeezed out between the platen roller 401 and the thermally-activating thermal head 400, thus separated from the base paper 500 of the heat-sensitive adhesive sheet R, as shown in FIG. 8A.

Furthermore, a separated heat-sensitive adhesive mass G1, as shown in FIG. 8A, has the adhesive force developed by the activation and hence, adheres to a peripheral surface of the platen roller 401 temporarily idling after the discharge of the heat-sensitive self-adhesive sheet R, as shown in FIG. 8B.

While the platen roller 401 is subjected to the state shown in FIGS. 8A and 8B in several cycles, the platen roller 401 sustains the adherence of multiple heat-sensitive adhesive masses G1 to its peripheral surface, as shown in FIG. 8C.

Furthermore, the heat-sensitive adhesive masses G1 on the periphery of the platen roller 401 are molten by repeated heating by the thermally-activating thermal head 400, thus exhibiting a strong adhesive force. Accordingly, some of the adhesive masses adhere to a surface of the subsequent heat-sensitive self-adhesive sheet R, contaminating a printable surface thereof.

In addition, there exists a problem that the peripheral surface of the platen roller 401 is deteriorated in smoothness due to the adherence of multiple heat-sensitive adhesive masses G1 and hence, the subsequent heat-sensitive adhesive layer K of the heat-sensitive self-adhesive sheet R cannot be uniformly heated, thus failing to exhibit a sufficient adhesive force.

In order to eliminate such problems, a user needs to regularly remove the masses adhered to the periphery of the platen roller with a cleaning solvent or exchange the platen rollers. This is cumbersome and also increases maintenance costs.

SUMMARY OF THE INVENTION

The invention has been contrived to solve the above problems and has an object to provide a thermal activation device for heat-sensitive adhesive sheet, which is capable of effectively removing the heat-sensitive adhesive masses adhered to the platen roller in a manner to save labor and cost, and a printer assembly employing the thermal activation device.

In accordance with the invention for achieving the above object, a thermal activation device (thermal activation unit A1) for heat-sensitive self-adhesive sheet at least comprises: a thermally-activating thermal head for thermally activating a heat-sensitive adhesive layer of a heat-sensitive self-adhesive sheet including a sheet-like substrate formed with a printable surface on one side thereof and with the heat-sensitive adhesive layer on the other side thereof; and a platen roller (41) for conveying the heat-sensitive self-adhesive sheet in a predetermined direction, the device characterized in that the platen roller includes adhesive-mass removing means for removing an adhesive mass of the heat-sensitive adhesive adhered to a periphery of the platen roller, and that the adhesive-mass removing means comprises: a transfer roller (42) slidably contacting the periphery of the platen roller as located near an exit of the heat-sensitive self-adhesive sheet, thereby allowing the adhesive mass adhered to the periphery of the platen roller to be transferred thereto; and a cleaning sheet (heat-sensitive self-adhesive sheet R) inserted through space between the transfer roller and the platen roller thereby removing the adhesive mass adhered to a periphery of the transfer roller by allowing the adhesive mass to be transferred thereto.

Thus, the adhesive mass on the surface of the platen roller is transferred to the transfer roller, whereas the adhesive mass transferred onto the periphery of the transfer roller is further transferred to the cleaning sheet so as to be removed. Accordingly, the periphery of the platen roller can be effectively cleaned while the adhesive mass transferred to the transfer roller is prevented from being transferred back to the platen roller.

In a mode, the cleaning sheet may comprise the heat-sensitive self-adhesive sheet. Accordingly, just continuing the operation of the thermal activation device for activating the heat-sensitive self-adhesive sheets permits the platen roller and the transfer roller to be automatically cleaned by the sheets, providing so-called self cleaning. Thus, the periphery of the platen roller is always maintained in the clean state in a manner to save labor and costs. The inventors have confirmed from experiment that even if the adhesive masses on the transfer roller 42 are transferred to the back side (where the heat-sensitive adhesive layer is formed) of the heat-sensitive self-adhesive sheet, the transferred masses do not decrease the adhesiveness to the support object.

In a mode, the device may be constructed in a manner to establish a relation: U4>U3>U2>U1, where U1 denotes a surface energy at the surface of the thermally-activating thermal head, U2 denotes a surface energy at the periphery of the platen roller, U3 denotes a surface energy at the periphery of the transfer roller, and U4 denotes a surface energy of the cleaning sheet at its contact surface with the transfer roller. This ensures an effective cleaning of the periphery of the platen roller because the heat-sensitive adhesive masses deposited on the surface of the thermal head are adhered to the periphery of the platen roller having the greater surface energy, the adhesive masses on the platen roller being adhered to the periphery of the transfer roller having the even greater surface energy, the adhesive masses on the transfer roller being adhered to the contact surface of the cleaning sheet having the far more greater surface energy. The surface energies U1 to U4 are controllable by way of chemical properties and physical properties, such as surface roughness, of the materials of the respective members.

In a mode, the transfer roller may have a smaller diameter than that of the platen roller. This provides a relatively small contact area between the cleaning sheet and the periphery of the transfer roller, thus serving the double purposes of preventing the cleaning sheet from being wound around the transfer roller and ensuring the positive transfer of the adhesive masses to the contact surface of the cleaning sheet.

In a mode, the transfer roller may be provided with cooling means for cooling the periphery thereof. This facilitates the transfer of the adhesive masses from the platen roller to the transfer roller because the adhesive masses on the platen roller, which are softened to be almost liquefied, are cooled as contacting the periphery of the transfer roller cooled by the cooling means, so that the adhesive masses are increased in viscosity, tending to be adhered to the transfer roller.

In a mode, the cooling means may comprise an air fan coaxially mounted to the transfer roller for applying air flow to the transfer roller; a plurality of hollow portions longitudinally extended through a roll body of the transfer roller, and an air-intake fin attached to a respective one end of the hollow portions; or a heat absorbing element disposed in contacting relation with a rotation axis of the transfer roller or with a bearing member for the rotation axis.

A printer assembly according to another aspect of the invention comprises the above thermal activation device for heat-sensitive self-adhesive sheet. Thus is provided the printer assembly for heat-sensitive self-adhesive sheet which prevents contamination of the printable surface of the heat-sensitive self-adhesive sheet by cleaning the periphery of the platen roller and which can fully activate the heat-sensitive adhesive layer for developing a consistent adhesive force.

In a mode, the printer assembly may further comprise a thermal head for performing printing as abutted against a heat-sensitive color developing layer of the heat-sensitive self-adhesive sheet having the printable surface formed with the heat-sensitive color developing layer. This permits the printer assembly to print on the heat-sensitive self-adhesive sheet based on the thermal printing system using the thermal head.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENT

Preferred embodiments of the invention will hereinbelow be described with reference to the accompanying drawings.

Figure 1:
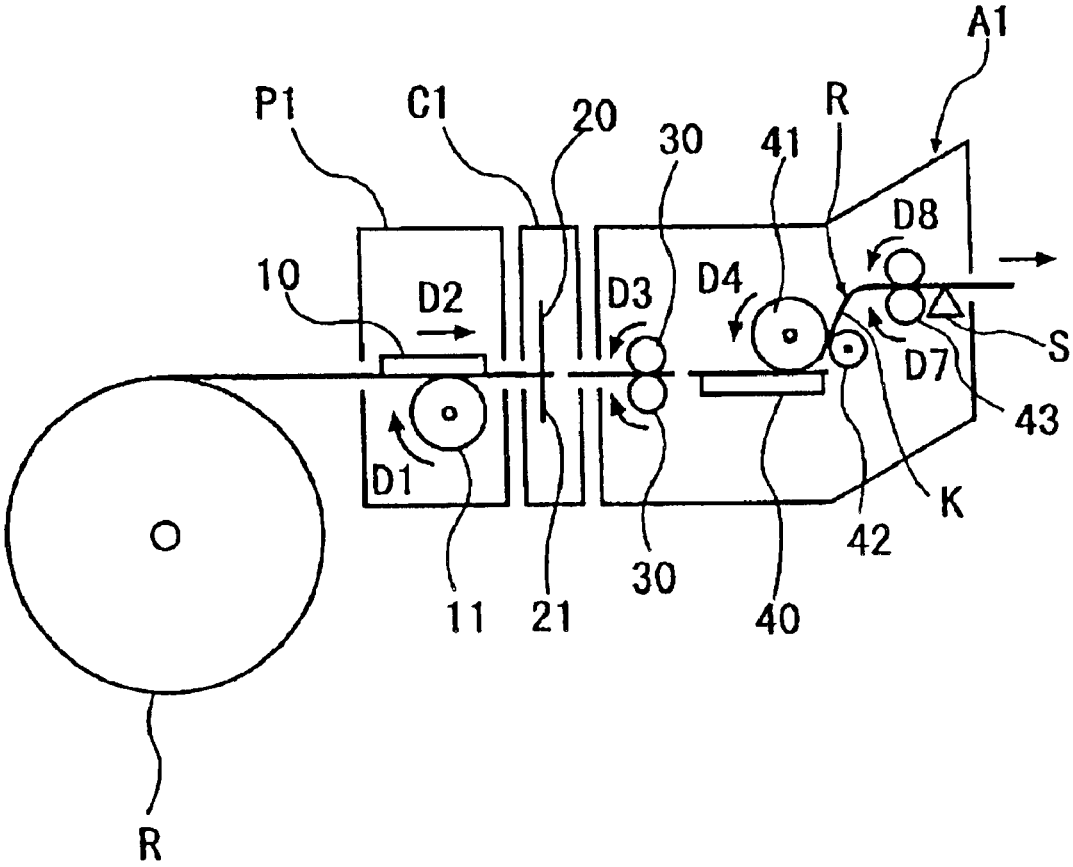
FIG. 1 is a schematic diagram showing an arrangement of a thermal printer assembly according to the invention.

FIG. 1 is a schematic diagram showing an arrangement of a thermal printer assembly according to the invention.

Referring to FIG. 1, a reference sign P1 represents a thermal printer unit, a sign C1 representing a cutter unit, a sign A1 representing a thermal activation unit as the thermal activation device, a sign R representing a heat-sensitive self-adhesive sheet wound into a roll.

Figure 6:
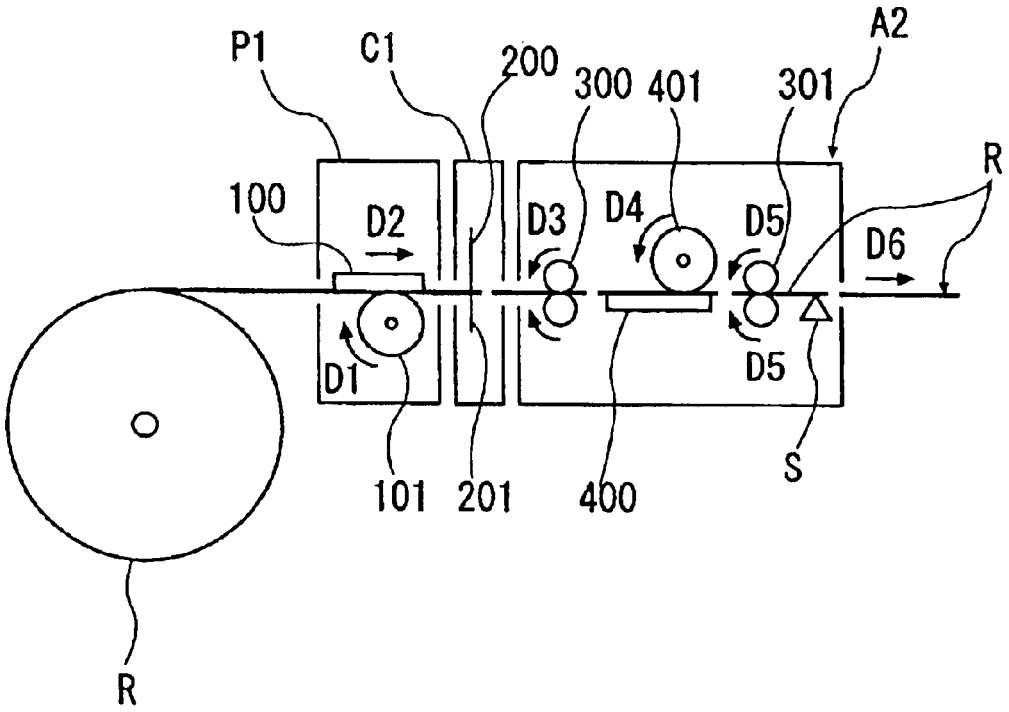
FIG. 6 is a schematic diagram showing an arrangement of a conventional thermal printer assembly.
Figure 7:
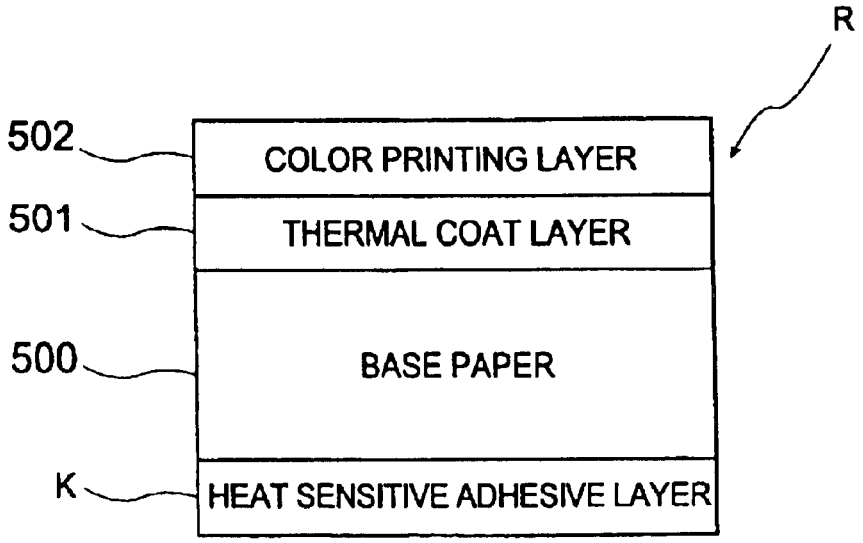
FIG. 7 is a sectional view showing a construction of a heat-sensitive self-adhesive sheet.
Figure 8A:
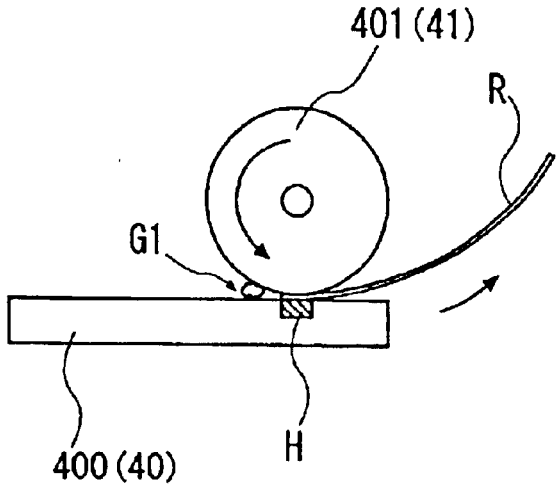
FIG. 8A PRIOR ART
FIG. 8 is a group of diagrams each explaining a state of an adhered mass such as of a heat-sensitive adhesive in a conventional thermal activation device.
Figure 8B:
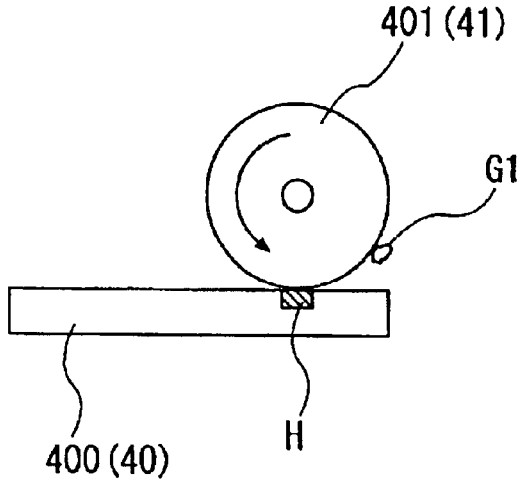
FIG. 8B PRIOR ART
Figure 8C:
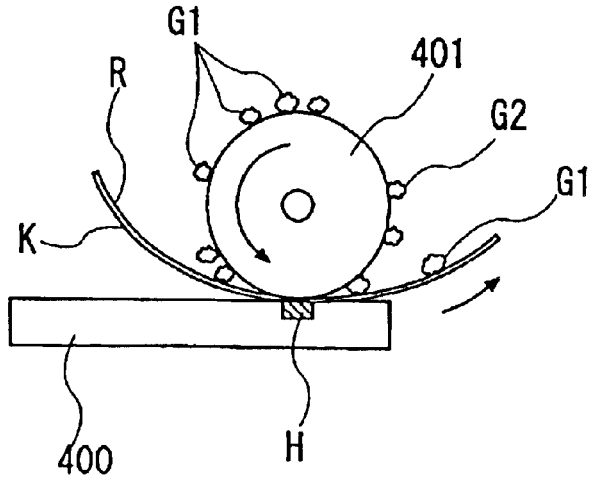
FIG. 8C PRIOR ART

The heat-sensitive self-adhesive sheet R has a construction as shown in FIG. 6, for example. As required, a heat insulating layer may be formed on the base paper 500. The thermal printer unit P1 includes a printing thermal head 10; a platen roller 11 pressed against the printing thermal head 10; and an unillustrated drive system (including an electric motor and gear array, for example) for rotating the platen roller 11.

As seen in FIG. 1, the platen roller 11 is rotated in the direction D1 (clockwise) thereby paying out the heat-sensitive self-adhesive sheet R, which is subjected to thermal printing and discharged in the direction D2 (rightward). The platen roller 11 includes unillustrated pressure means (such as a helical spring or plate spring) a resilient force of which acts to bias the platen roller 11 surface against the printing thermal head 10. Based on a print signal from an unillustrated print control unit, the printing thermal head 10 and the printing platen roller 11 are operated for accomplishing a desired printing on the thermal coat layer 501 of the heat-sensitive self-adhesive sheet R.

A heat generating element of the printing thermal head 10 includes a plurality of relatively small resistances arranged along a width of the head for permitting dot printing. On the other hand, a heat generating element H of a thermally-activating thermal head 40 to be described herein later needs not be divided into dot regions unlike those of the printing thermal head and may be formed of a continuous resistance. Alternatively, the printing thermal head 10 and the thermally-activating thermal head 40 may share the resistance of the same construction for the purpose of cost reduction.

The cutter unit C1 serves to cut the heat-sensitive self-adhesive sheet R in a suitable length, the heat-sensitive adhesive label thermally printed by the thermal printer unit P1. The cutter unit C1 includes a movable blade 20 operated by a drive source (not shown) such as an electric motor, and a fixed blade 21 and the like. The movable blade 20 is operated at a predetermined timing under control of an unillustrated control unit.

The thermal activation unit Al includes a insertion roller 30 and a discharge roller 43 which are rotated by an unillustrated drive source, for example, for insertion and discharge of the cut heat-sensitive self-adhesive sheet R; and the thermally-activating thermal head 40, a thermally-activating platen roller 41 pressed against the thermally-activating thermal head 40, and a transfer roller 42 which are interposed between the insertion roller 30 and discharge roller 43

The thermally-activating platen roller 41 includes an unillustrated drive system (including an electric motor and gear array, for example), which rotates the platen roller 41 in the direction D4 (the counter-clockwise direction as seen in FIG. 1) so that the heat-sensitive adhesive sheet R is conveyed in the rightward direction as seen in FIG. 1 by means of the insertion roller 30 and discharge roller 31 rotated in the respective directions D3 and D8.

The thermally-activating platen roller 41 further includes unillustrated pressure means (such as a helical spring or plate spring), a resilient force of which acts to bias the thermally-activating platen roller 41 surface against the thermally-activating thermal head 40. The thermally-activating platen roller. 41 is formed of, for example, a hard rubber or the like.

The transfer roller 42 includes a roller having a smaller diameter than the thermally-activating platen roller 41 and is disposed as a driven roller brought into rotation in association with sliding contact with a peripheral surface of the thermally-activating platen roller 41. That is, the transfer roller 42 is rotated in a direction D7 according to the rotation of the thermally-activating platen roller 41 in the direction D4. At delivery of the heat-sensitive self-adhesive sheet R, the thermally-activating platen roller 41 and the transfer roller 42 clamp the heat-sensitive self-adhesive sheet R therebetween thereby discharging the sheet to the discharge roller 43. When the heat-sensitive self-adhesive sheet R is absent, the transfer roller 42 directly contacts the periphery of the thermally-activating platen roller 41 so that the heat-sensitive adhesive masses on the periphery of the thermally-activating platen roller 41 are transferred to a periphery of the transfer roller 42. This ensures that the periphery of the thermally-activating platen roller 41 is always maintained in a clean state.

According to the embodiment, the heat-sensitive self-adhesive sheet R itself serves as a cleaning sheet for cleaning the periphery of the transfer roller 42. The heat-sensitive self-adhesive sheets R delivered one after another present their heat-sensitive adhesive layers K against the periphery of the transfer roller 42, thereby removing the masses adhered to the periphery of the transfer roller 42. Hence, just continuously feeding the heat-sensitive self-adhesive sheets R permits the transfer roller 42 to be automatically cleaned by the heat-sensitive self-adhesive sheets R, providing so-called self cleaning. Thus, the periphery of the thermally-activating platen roller 41 is constantly maintained in the clean state in a manner to save labor and costs. The inventors have confirmed from experiment that even if the masses on the transfer roller 42 are transferred to the back side (the surface of the heat-sensitive adhesive layer K) of the heat-sensitive self-adhesive sheet R, the transferred masses do not decrease the adhesiveness to the support object.

The arrangement may desirably be so made as to establish a relation U4>U3>U2>U1, where U1 denotes a surface energy at the surface of the thermally-activating thermal head 40, U2 denoting a surface energy at the periphery of the thermally-activating platen roller 41, U3 denoting a surface energy at the periphery of the transfer roller 42, U4 denoting a surface energy at the heat-sensitive adhesive layer K of the heat-sensitive self-adhesive sheet R as the cleaning sheet. The surface energies U1 to U4 are controllable by way of chemical properties or physical properties, such as surface roughness, of the materials of the individual members.

For example, a fluorine resin or the like may be coated on the surface of the thermally-activating thermal head 40 and the peripheries of the thermally-activating platen roller 41 and transfer roller 42 for controlling the respective magnitudes of surface energies thereof based on the chemical properties of the resin.

In another approach, for example, the surface of the transfer roller 42 may be roughened to produce micropores thereon in order to attain a greater surface energy than that of the periphery of the thermally-activating platen roller 41.

Thus, the heat-sensitive adhesive masses deposited on the surface of the thermally-activating thermal head 40 are allowed to adhere to the periphery of the thermally-activating platen roller 41 having the greater surface energy. The masses adhered to the thermally-activating platen roller 41 are allowed to adhere to the periphery of the transfer roller 42 having the even greater surface energy. The masses adhered to the transfer roller 42 are allowed to adhere to the surface of the heat-sensitive adhesive layer K of the heat-sensitive self-adhesive sheet R having the far more greater surface energy and thus are removed. This provides for an effective cleaning of the periphery of the thermally-activating platen roller 41 while preventing the re-adherence of the adhesive masses to the thermally-activating platen roller.

In FIG. 1, a reference sign S represents a discharge detection sensor for detecting the discharge of a heat-sensitive self-adhesive sheet R. The printing, conveyance and thermal activation of the subsequent heat-sensitive self-adhesive label R are performed in response to the discharge detection sensor S detecting the discharged heat-sensitive self-adhesive sheet R.

Next, operations of the thermal printer assembly according to the embodiment will be described with reference to FIGS. 1 and 2. FIG. 2 are diagrams illustrative of states where adhesive masses adhered to the thermally-activating platen roller are removed.

When the thermal printer assembly is activated, the thermal printer unit P1 carries out the thermal printing on the printable surface (the thermal coat layer 501) of the heat-sensitive self-adhesive sheet R. Subsequently, the heat-sensitive self-adhesive sheet R is conveyed to the cutter unit Cl via rotation of the printing platen roller 11, so as to be cut in a predetermined length by the movable blade 20 operated at a predetermined timing.

Then, the heat-sensitive self-adhesive sheet R thus cut is introduced into the thermal activation unit A1 by means of the insertion roller 30 thereof, so as to be applied with a thermal energy by the thermally-activating thermal head 40 (the heat generating element H) and the thermally-activating platen roller 41 which are operated by an unillustrated control unit at a predetermined timing. Accordingly, the heat-sensitive adhesive layer K of the heat-sensitive self-adhesive sheet R is activated to develop the adhesive force.

Then, as clamped between the thermally-activating platen roller 41 and the transfer roller 42, the heat-sensitive self-adhesive sheet R is discharged to the discharge roller 43 and to the outside of the thermal printer assembly.

Figure 2A:
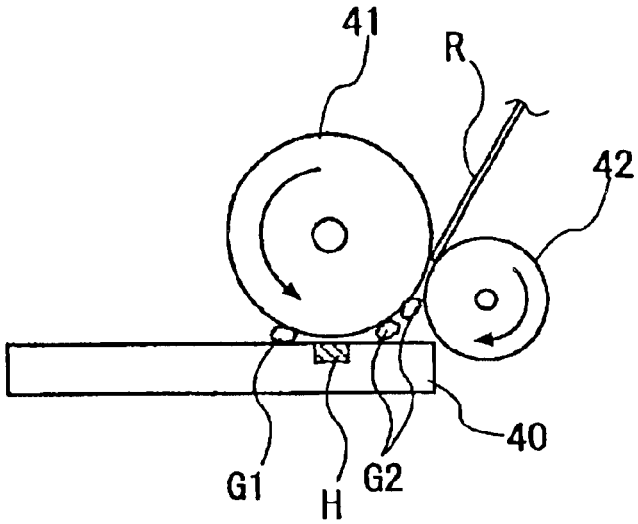
FIG. 2 is a group of diagrams explanatory of states where an adhesive mass adhered to a thermally-activating platen roller is removed.
Figure 2B:
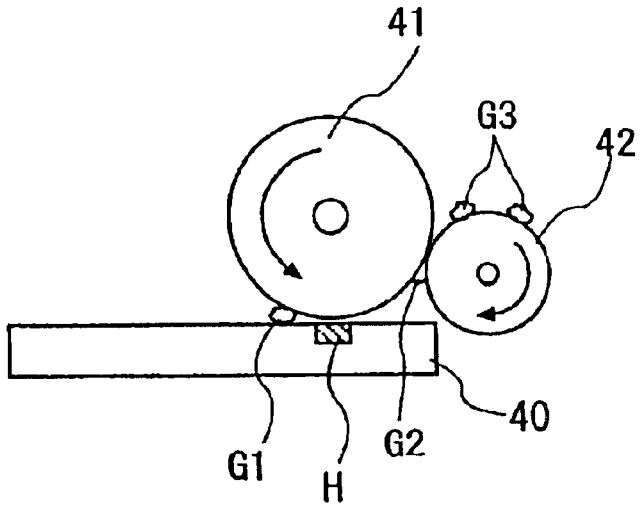
Figure 2C:
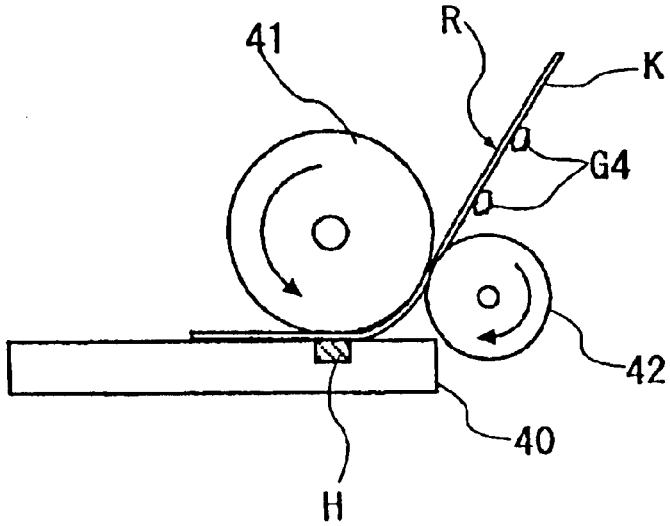

When the heat-sensitive self-adhesive sheet R is thermally activated at the heat-sensitive adhesive layer K thereof by means of the heat generating element H of the thermally-activating thermal head 40 and then released from the platen roller 41, a part of the heat-sensitive adhesive of the heat-sensitive adhesive layer K, softened by heating, is squeezed out between the thermally-activating platen roller 41 and the thermally-activating thermal head 40, thus separated from the base paper 500 of the heat-sensitive self-adhesive sheet R and adhered as adhesive mass G1 (see FIG. 2A).

The resultant adhesive mass G1 having the adhesive force due to the activation adheres to the periphery of the thermally-activating platen roller 41 temporarily idling after the discharge of the heat-sensitive self-adhesive sheet R, thus forming a transferred adhesive mass G2 on the periphery of the thermally-activating platen roller 41 (see FIG. 2A). In this process, the adhesive mass G1 on the surface of the thermally-activating thermal head 40 is prone to be transferred to the periphery of the thermally-activating platen roller 41 because the surface energy U1 at the surface of the thermally-activating thermal head 40 is made lower than the surface energy U2 at the periphery of the thermally-activating platen roller 41. Therefore, the adhesive mass G1 adhered to the surface of the thermally-activating thermal head 40 is effectively removed. This obviates the scorched fixing of the adhesive mass G1 or prevents the thermally-activating thermal head 40 from being decreased in thermal activation performance due to the deposition of the adhesive mass G1 thereon.

Subsequently, the thermally-activating platen roller 41 and the transfer roller 42 are rotated indirect circumferential contact with each other for a given period of time before the arrival of the subsequent heat-sensitive self-adhesive sheet R. In this state, the adhesive mass G2 adhered to the periphery of the thermally-activating platen roller 41 is transferred to the periphery of the transfer roller 42 to form a transferred adhesive mass G3 (see FIG. 2B). In this process, the adhesive mass G2 on the periphery of the thermally-activating platen roller 41 is prone to be transferred to the periphery of the transfer roller 42 because the surface energy U2 at the periphery of the thermally-activating platen roller 41 is made smaller than the surface energy U3 at the periphery of the transfer roller 42. Therefore, the adhesive mass G2 on the periphery of the thermally-activating platen roller 41 is effectively removed. This obviates the problem that the subsequent heat-sensitive self-adhesive sheet R delivered by the thermal activation unit A1 suffers contamination on the printable surface thereof (the surface of the colored print layer 502) during the thermal activation of the heat-sensitive self-adhesive sheet R, or that the thermally-activating platen roller 41 with the adhesive mass G2 deposited on its periphery is in inconsistent contact with the thermally-activating thermal head 40, which fails to accomplish the adequate thermal activation of the sheet.

When the subsequent heat-sensitive self-adhesive sheet R is delivered, the sheet is introduced into the thermal activation unit A1 by the insertion roller 30 thereof. The sheet is thermally activated according to the above procedure and then discharged to the discharge roller 43 as clamped between the thermally-activating platen roller 41 and the transfer roller 42. In this process, the adhesive mass G3 adhered to the periphery of the transfer roller 42 is transferred to the heat-sensitive adhesive layer K of the heat-sensitive self-adhesive sheet R which is increased in the adhesive force by the thermal activation, thus forming an adhesive mass G4 on the heat-sensitive adhesive layer K (see FIG. 2C).

Since the surface energy U3 at the periphery of the transfer roller 42 is made lower than the surface energy U4 at the surface of the heat-sensitive adhesive layer K of the heat-sensitive self-adhesive sheet R, the adhesive mass G3 on the periphery of the transfer roller 42 is prone to be transferred to the surface of the heat-sensitive adhesive layer K of the heat-sensitive self-adhesive sheet R. In addition, the transfer roller 42 has a smaller diameter than the thermally-activating platen roller 41. This provides a relatively small contact area between the heat-sensitive self-adhesive sheet R. and the periphery of the transfer roller 42, thus effectively serving the double purposes of preventing the heat-sensitive self-adhesive sheet R from being wound around the transfer roller 42 and ensuring the positive transfer of the adhesive mass to the contact surface of the heat-sensitive self-adhesive sheet R.

Thus, the embodiment assures that the heat-sensitive adhesive masse G2 adhered to the thermally-activating platen roller 41 is positively removed in a labor saving manner. Accordingly, when the subsequent heat-sensitive self-adhesive sheet R delivered from the thermal activation unit A1 is thermally activated, the embodiment can obviate the problems associated with the adhesive mass contaminating the printable surface of the sheet (the surface of the colored print layer 502) and with the insufficient thermal activation resulting from the inconsistent contact between the thermally-activating thermal head 40 and the periphery of the thermally-activating platen roller 41 having the adhesive mass G2 deposited thereon. Furthermore, the embodiment achieves an improved maintenance performance by implementing the self cleaning.

In addition, the transfer roller 42 may be provided with cooling means for cooling the periphery of the transfer roller 42. Thus, the adhesive mass G2 on the periphery of the thermally-activating platen roller 41, which is softened to a degree to be almost liquefied, contacts the periphery of the transfer roller 42 cooled by the cooling means, whereby the adhesive mass G2 is cooled and increased in viscosity so as to tend to adhere to the transfer roller 42. This facilitates the transfer of the adhesive mass G3 from the thermally-activating platen roller 41 to the transfer roller 42. The cooling means may have any of the arrangements shown in FIGS. 3 and 4.

Figure 3A:
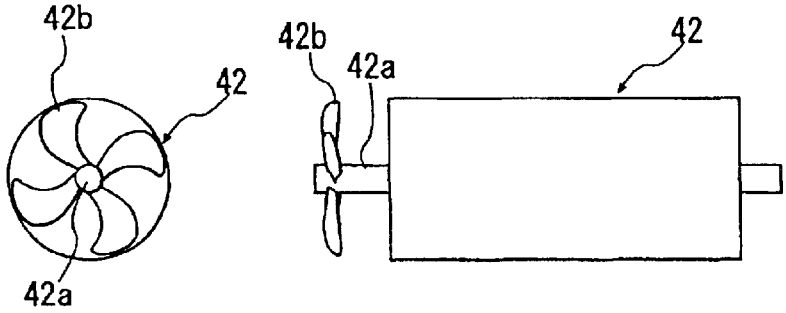
FIG. 3 is a group of diagrams each illustrating an example of cooling means for a transfer roller.

FIG. 3A illustrates an example of the cooling means comprised of an air fan 42*b* mounted to an end of a rotation axis 42*a* of the transfer roller 42 for applying air flow to the transfer roller 42. This permits the periphery of the transfer roller 42 to be air-cooled.

Figure 3B:
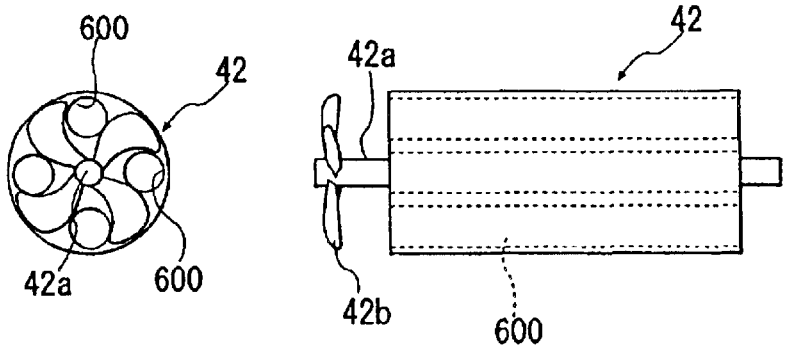

FIG. 3B illustrates an example of modification from the example of FIG. 3A, the modification wherein a plurality of hollow portions 600 are longitudinally extended through a roll body of the transfer roller 42. This arrangement permits the air flow from the air fan 42*b* to flow along and through the periphery and the hollow portions 600 of the transfer roller 42, providing for a more efficient cooling of the transfer roller 42.

Figure 3C:
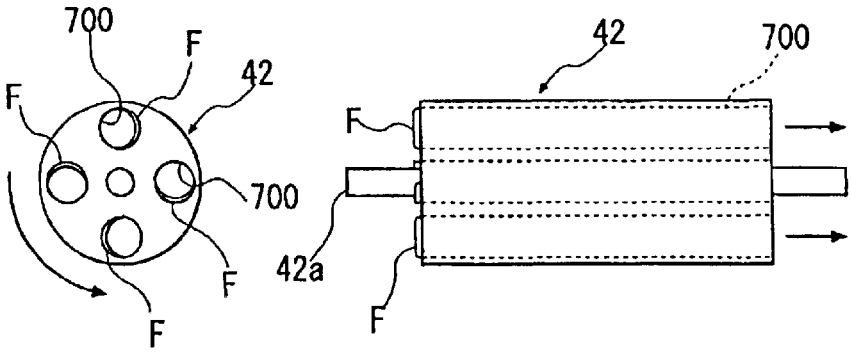

FIG. 3C illustrates an example of the cooling means wherein a plurality of hollow portions 700 are longitudinally extended through the roll body of the transfer roller 42 and are each provided with an air-intake fin F at one end thereof. This arrangement is adapted to cool the transfer roller 42 in a manner that the rotation of the transfer roller 42 permits the air in-take fin F to draw the air into the hollow portion 700, the air flowing through the hollow portion to be discharged from the other end thereof.

Figure 4:
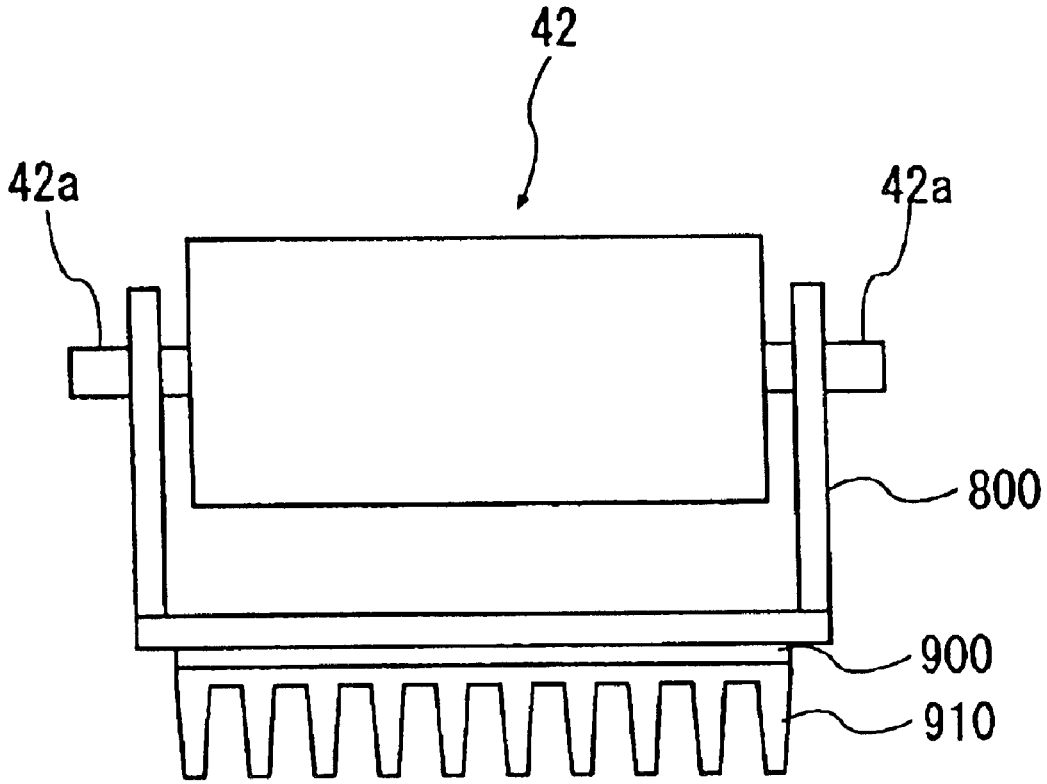
FIG. 4 is a diagram explanatory of another example of the cooling means for the transfer roller.

FIG. 4 illustrates an example of the cooling means wherein a heat absorbing element (e.g., berthierite element) 900 is disposed at a bottom of a bearing member 800 for the rotation axis 42*a* of the transfer roller 42. In this arrangement, the heat absorbing member 900 is energized to absorb heat from the bearing member 800, whereby the transfer roller 42 in contact with the bearing member 800 is cooled via a heat releasing member 910. Incidentally, the heat absorbing element 900 may be replaced by a water-cooling jacket or heat absorbing sheet.

Although the invention accomplished by the inventors has been specifically described with reference to the embodiments thereof, it is to be understood that the invention is not limited to the foregoing embodiments but various changes and modifications may be made thereto within the scope of the invention.

For instance, the embodiment illustrates the example where the removal of the adhesive mass G3 adhered to the periphery of the transfer roller 42 is accomplished by way of the surface of the heat-sensitive adhesive layer K of the subsequent heat-sensitive self-adhesive sheet R, but the removal of the adhesive mass is not limited to this.

Alternatively, a specialty sheet for cleaning which is provided with a certain surface treatment may be used.

Figure 5A:
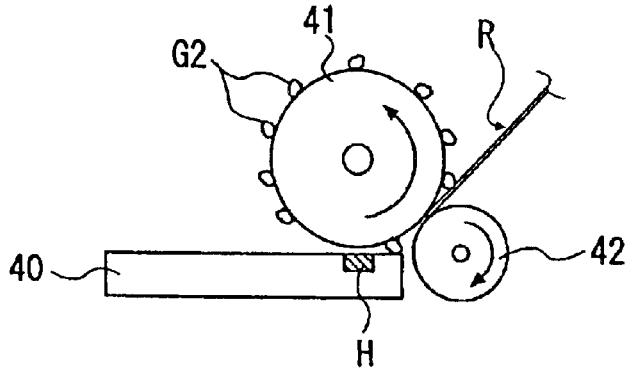
FIG. 5 is a group of diagrams explanatory of a method for removing the adhesive mass.
Figure 5B:
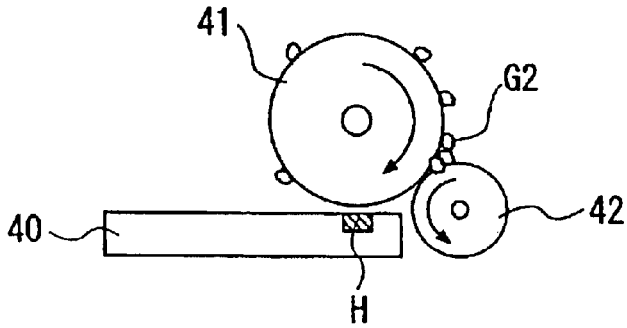
Figure 5C:
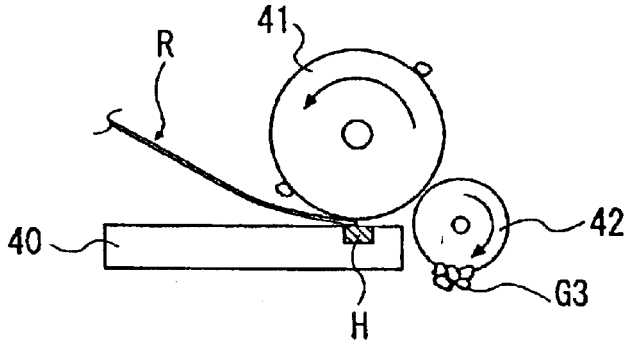
Figure 5D:
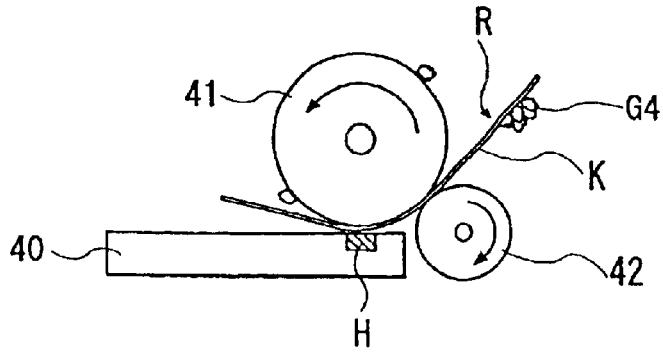

Alternatively, the adhesive mass may be removed as follows. In a state where the adhesive masses G2 are adhered to the thermally-activating platen roller 41 as shown in FIG. 5A, the transfer roller 42 is temporarily halted, as shown in FIG. 5B. The thermally-activating platen roller 41 alone is reversely rotated to gather the adhesive masses G3 and then, both the thermally-activating platen roller 41 and the transfer roller 42 are normally rotated to collectively transfer the gathered adhesive masses G3 to the transfer roller (see FIG. 5C), so that the adhesive masses G4 are allowed to transfer to the surface of the heat-sensitive adhesive layer K of the subsequent heat-sensitive self-adhesive sheet R and removed (see FIG. 5D).

The foregoing embodiment illustrates the case where the printer unit adopts the thermal printing system. However, the invention is not limited to this and may adopt any of the ink-jet printing system, laser printing system and the like. In such cases, heat-sensitive self-adhesive sheets with their printable surfaces suitably processed for the respective printing systems are used in place of the sheet having the printable surface of the thermal coat layer.

As mentioned supra, the thermal activation device for heat-sensitive self-adhesive sheet according to the invention at least includes: the thermally-activating thermal head for thermally activating the heat-sensitive adhesive layer of the heat-sensitive self-adhesive sheet including the sheet-like substrate formed with the printable surface on one side thereof and with the heat-sensitive adhesive layer on the other side thereof; and the platen roller for conveying the heat-sensitive self-adhesive sheet in a predetermined direction, the device characterized in that the platen roller includes the adhesive-mass removing means for removing the adhesive mass of the heat-sensitive adhesive adhered to the periphery of the platen roller, and that the adhesive-mass removing means includes: the transfer roller slidably contacting the periphery of the platen roller as located near the exit of the heat-sensitive self-adhesive sheet, thereby allowing the adhesive mass adhered to the periphery of the platen roller to be transferred thereto; and the cleaning sheet inserted through space between the transfer roller and the platen roller thereby removing the adhesive mass adhered to the periphery of the transfer roller by allowing the adhesive mass to be transferred thereto. Thus, the adhesive mass adhered to the surface of the platen roller is transferred to the transfer roller, while the adhesive mass adhered to the periphery of the transfer roller is transferred to the cleaning sheet and removed. Accordingly, there is achieved an advantage that the periphery of the platen roller is effectively cleaned while the adhesive mass transferred to the transfer roller is prevented from being re-adhered to the platen roller.

What is claimed is:

1. A thermal activation device for heat-sensitive self-adhesive sheet comprising:

a thermally-activating thermal head for thermally activating a heat-sensitive adhesive layer of a heat-sensitive self-adhesive sheet including a sheet-like substrate formed with a printable surface on one side thereof and with the heat-sensitive adhesive layer on the other side thereof; and a platen roller for conveying the heat-sensitive self-adhesive sheet in a predetermined direction;

wherein the platen roller comprises adhesive-mass removing means for removing an adhesive mass of the heat-sensitive adhesive adhered to a periphery of the platen roller, and the adhesive-mass removing means comprises a transfer roller slidably contacting the periphery of the platen roller as located near an exit of the heat-sensitive self-adhesive sheet, thereby allowing the adhesive mass adhered to the periphery of the platen roller to be transferred thereto and a cleaning sheet inserted through space between the transfer roller and the platen roller thereby removing the adhesive mass adhered to a periphery of the transfer roller by allowing the adhesive mass to be transferred thereto.

2. A thermal activation device for heat-sensitive self-adhesive sheet according to claim 1, wherein the cleaning sheet comprises the heat-sensitive self-adhesive sheet.

3. A thermal activation device for heat-sensitive self-adhesive sheet according to claim 1, wherein the device is constructed in a manner to establish a relation: U4>U3>U2>U1, where U1 denotes a surface energy at the surface of the thermally-activating thermal head, U2 denotes a surface energy at the periphery of the platen roller, U3 denotes a surface energy at the periphery of the transfer roller, and U4 denotes a surface energy of the cleaning sheet at its contact surface with the transfer roller.

4. A thermal activation device for heat-sensitive self-adhesive sheet according to claim 1, wherein the transfer roller has a smaller diameter than that of the platen roller.

5. A thermal activation device for heat-sensitive self-adhesive sheet according to claim 1, wherein the transfer roller is provided with cooling means for cooling the periphery thereof.

6. A thermal activation device for heat-sensitive self-adhesive sheet according to claim 5, wherein the cooling means comprises an air fan coaxially mounted to the transfer roller for applying air flow to the transfer roller.

7. A thermal activation device for heat-sensitive self-adhesive sheet according to claim 5, wherein the cooling means comprises a plurality of hollow portions longitudinally extended through a roll body of the transfer roller, and an air-intake fan attached to respective one end of the hollow portions.

8. A thermal activation device for heat-sensitive self-adhesive sheet according to claim 5, wherein the cooling means comprises a heat absorbing element disposed in contacting relation with a rotation axis of the transfer roller or with a bearing member for the rotation axis.

9. A printer assembly comprising the thermal activation device for heat-sensitive self-adhesive sheet according to claim 1.

10. A printer assembly according to claim 9, further comprising a thermal head for performing printing as abutted against a heat-sensitive color developing layer of the heat-sensitive self-adhesive sheet having the printable surface formed with the heat-sensitive color developing layer.

* * * * *